US005244402A

United States Patent [19]

Pasterchick, Jr. et al.

[11] Patent Number: 5,244,402

[45] Date of Patent: Sep. 14, 1993

[54] SOCKET FOR MULTIPLE TYPES OF TELEPHONE PLUGS

[75] Inventors: Harry Pasterchick, Jr.; Albert C. Ruocchio, both of Raleigh, N.C.

[73] Assignee: International Business Machines Corporation, Armonk, N.Y.

[21] Appl. No.: 993,176

[22] Filed: Dec. 18, 1992

[51] Int. Cl.[5] ..... H01R 13/00

[52] U.S. Cl. ..... 439/217; 439/676

[58] Field of Search ..... 439/217-224, 439/676

[56] References Cited

U.S. PATENT DOCUMENTS 5,096,441 3/1992 Jaag ..... 439/218

5,118,312 6/1992 Lu ..... 439/218

*Primary Examiner*—Joseph H. McGlynn

*Attorney, Agent, or Firm*—Stephen T. Keohane

[57] ABSTRACT

A connector socket may receive either a plain old telephone service (POTS) connector plug or an Integrated Services Digital Network (ISDN) Basic Rate connector plug. The connector socket comprises a body having a plug-receiving chamber for receiving either a POTS or an ISDN connector plug. The chamber has eight contact terminals are disposed along a top side for providing connectivity to the corresponding eight contact terminals of the ISDN connector plug when inserted within the chamber. Likewise, six contact terminals are disposed along a bottom side of the chamber for providing connectivity to the corresponding two, four or six contact terminals of the POTS connector plug when inserted within the chamber. The chamber further has a POTS plug guide for guiding and locking the POTS plug in the chamber and an ISDN plug guide for guiding and locking the ISDN plug in the chamber. The POTS plug guide is sufficiently laterally offset from the ISDN plug guide so that each plug may be independently inserted and locked in the chamber without the need for spacer plates.

6 Claims, 4 Drawing Sheets

SOCKET FOR MULTIPLE TYPES OF TELEPHONE PLUGS

BACKGROUND OF THE INVENTION

I. Field of the Invention

The present invention relates to sockets for telephone plugs and, more particularly, to a female socket for receiving one of multiple types of male telephone plugs.

II. Prior Art

Global competition is driving the need for portable data processing and telecommunications capabilities. Portable personal computers (PCs) are provided with greater and greater processing capabilities while getting smaller in size. As exemplified in the latest notebook and handheld PCs, physical space on PCs is a premium.

In addition to greater processing capabilities and smaller physical size, there is an increasing need for PCs to have communications capabilities, especially over the existing telecommunications networks. As a result, many present PCs have built-in adapters for interfacing with the telecommunications networks. Examples of telecommunications adapters are modems for interfacing with the standard analog telecommunications networks or plain old telephone service (POTS), and, for the Integrated Services Digital Network (ISDN) Basic Rate service, ISDN Basic Rate adapters. These adapters convert the computer data to be transmitted into the corresponding telecommunications network format and protocol and vice versa. Also, they provide connectivity to the network via connectors which, in the case of POTS and analog modems, conform to the RJ-11 standard and, in the case of Basic Rate ISDN, conform to the RJ-45 standard.

Presently, the type of telecommunications service available in areas around the world is not uniform. For example, in the United States, POTS is the available telecommunications service, while in Europe, ISDN Basic Rate is the generally available service. Also, the common carriers in the United States have announced plans to deploy ISDN Basic Rate in the future. Thus, it is sometimes desirable for PCs to be outfitted with more than one type of adapter, for instance, a modem for POTS and an ISDN Basic Rate adapter for ISDN. At the very least, the PC's telecommunications adapters should be easily replaceable.

But, even where a PC is outfitted with a modem for POTS and an ISDN adapter for ISDN, a connectivity problem exists as POTS connector sockets conforming to RJ-11 for receiving connector plugs conforming to RJ-11 are not able to receive ISDN Basic Rate connector plugs conforming to RJ-45 and vice versa. This is because the ISDN Basic Rate connector plug is wider than the POTS connector plug and has eight contact terminals rather than the two, four or six contact terminals of the POTS connector plug. As a result, unless the PC is outfitted with a connector socket which is dimensioned to receive both RJ-11 and RJ-45 connector plugs, the PC connector socket will have to be replaced. This manual process can be burdensome, time-consuming and costly. In the alternative, two connector sockets, one POTS RJ-11 and one ISDN Basic Rate RJ-45, can be supplied on the computer. This is also costly and somewhat wasteful as two connector sockets are provided although only one will be used at any given time in most cases. Additionally, the extra connector socket consumes valuable space on the PC chassis.

Jaag, U.S. Pat. No. 5,096,441, shows a connector socket for use in a telecommunications system which can receive either a POTS connector plug or an ISDN Basic Rate connector plug. The Jaag connector socket has a plug-receiving chamber dimensioned so that it can receive the wider 8-contact ISDN Basic Rate connector plug. The connector socket has eight contact terminals on the bottom side of the chamber for providing connectivity with the ISDN Basic Rate connector plug. The Jaaq connector socket may also receive the narrower POTS connector plug by the provision of two plates, one plate for being wedged along either side of the POTS connector plug so that the plug will not move about laterally within the connector socket. The same contact terminals along the bottom side of the chamber are used to connect with the POTS connector plug. The problem is that the removable plates, because of their small size, are not easy to handle and are quite easily lost or misplaced.

SUMMARY OF THE INVENTION

The present invention comprises a connector socket for receiving either a plain old telephone service (POTS) connector plug or an Integrated Services Digital Network (ISDN) Basic Rate connector plug. The connector socket comprises a body having a plug-receiving chamber for receiving either a POTS or an ISDN connector plug. The chamber has eight contact terminals are disposed along a top side for providing connectivity to the corresponding eight contact terminals of the ISDN connector plug when inserted within the chamber. Likewise, six contact terminals are disposed along a bottom side of the chamber for providing connectivity to the corresponding two, four or six contact terminals of the POTS connector plug when inserted within the chamber. The chamber further has a POTS plug guide for guiding and locking the POTS plug in the chamber and an ISDN plug guide for guiding and locking the ISDN plug in the chamber. The POTS plug guide is sufficiently laterally offset from the ISDN plug guide so that each plug may be independently inserted and locked in the chamber without the need for spacer plates.

BRIEF DESCRIPTION OF THE DRAWINGS

While the technical description concludes with claims particularly pointing out and distinctly claiming that which is regarded as the invention, details of a preferred embodiment of the invention may be more readily ascertained from the following technical description when read in conjunction with the accompanying drawings, where:

DETAILED DESCRIPTION OF THE PREFERRED EMBODIMENT

Figure 1:
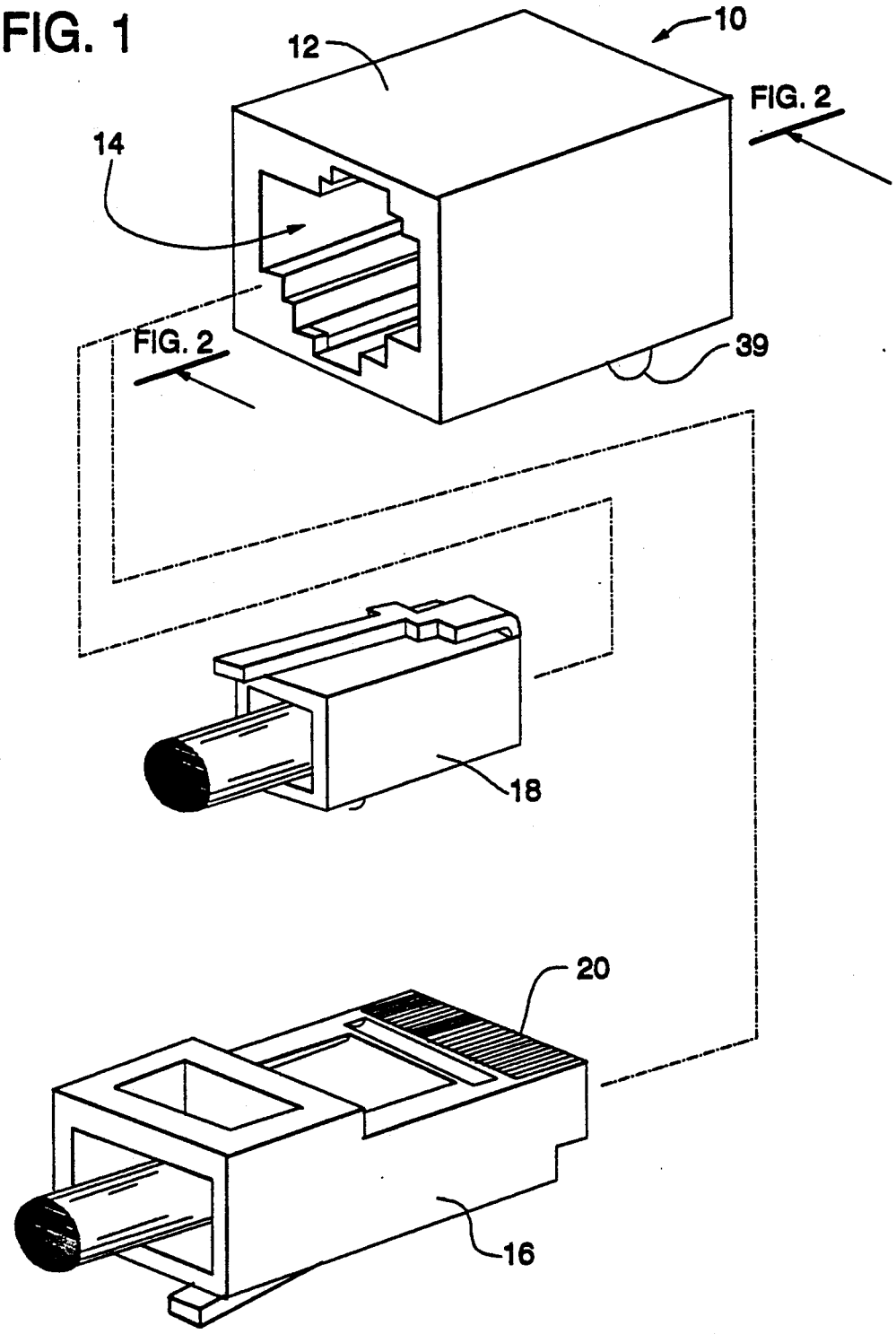
FIG. 1 is a perspective view of the socket of the present invention having a POTS-type connector plug and an ISDN Basic Rate-type connector plug exploded therefrom.

As shown in FIG. 1, the socket 10 of the present invention comprises a body 12 having a plug-receiving chamber 14 for receiving either an Integrated Services Digital Network (ISDN) Basic Rate connector plug 16 in one orientation or a plain old telephone system (POTS) connector plug 18 in another orientation, rotated 180 degrees from the ISDN plug orientation. ISDN Basic Rate connector plug 16 and POTS connector plug 18 conform to the RJ-45 and RJ-11 standards, respectively. As discussed above, ISDN Basic Rate connector plug 16 and POTS connector plug 18 differ in two main respects: first, ISDN Basic Rate connector plug 16 is wider than POTS connector plug 18 and, second, the ISDN Basic Rate connector plug 16 has eight contact terminals while the POTS connector plug 18 may have two, four or six contact terminals. The socket of the present invention accommodates any of these configurations without the need for spacer plates or the like.

Each of the plugs 16 and 18 have contact terminals 20 (not shown on plug 18) for providing connectivity to the socket 10. Socket 10 has corresponding contact terminals 22 and 24 (FIG. 2 and FIG.4) for making contact with the contact terminals of plugs 16 and 18, respectively. As can be seen, contact terminals 22 are disposed on an upper inner wall 26 of the chamber 14 for receiving the contact terminals of plug 16 while contact terminals 24 are disposed on a lower inner wall 28 of the chamber 14 for receiving the contact terminals of plug 18 which is rotated 180 degrees from plug 16 when inserted.

Figure 3:
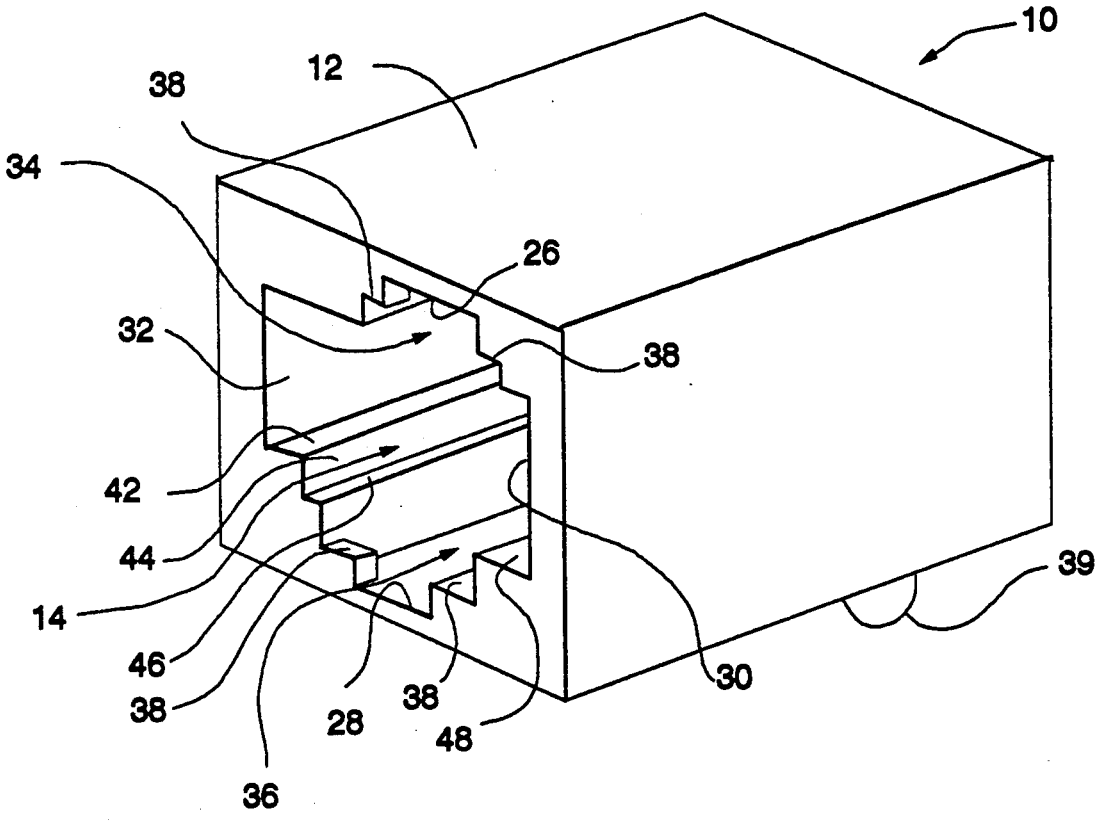
FIG. 3 is an enlarged perspective view of the socket of the present invention.

FIG. 3 shows an enlarged view of the socket 10 of the present invention. As noted above, the socket comprises a body 12 having a plug-receiving chamber 14 extending partially therethrough. The chamber 14 has an upper wall 26, a lower wall 28, a right side wall 30 and a left side wall 32. The chamber 14 further comprises a POTS plug guide portion 34 and an ISDN plug guide portion 36 which are used for guiding and locking the POTS plug and the ISDN plug, respectively, into the chamber. Both the POTS plug guide portion 34 and the ISDN plug guide portion 36 have snap-in protrusions 38. When either the POTS plug or the ISDN plug is inserted, snap-in levers of the respective plug lockingly engage behind the snap-in protrusions 38 in order to lock the plug into the socket 10.

Figure 2:
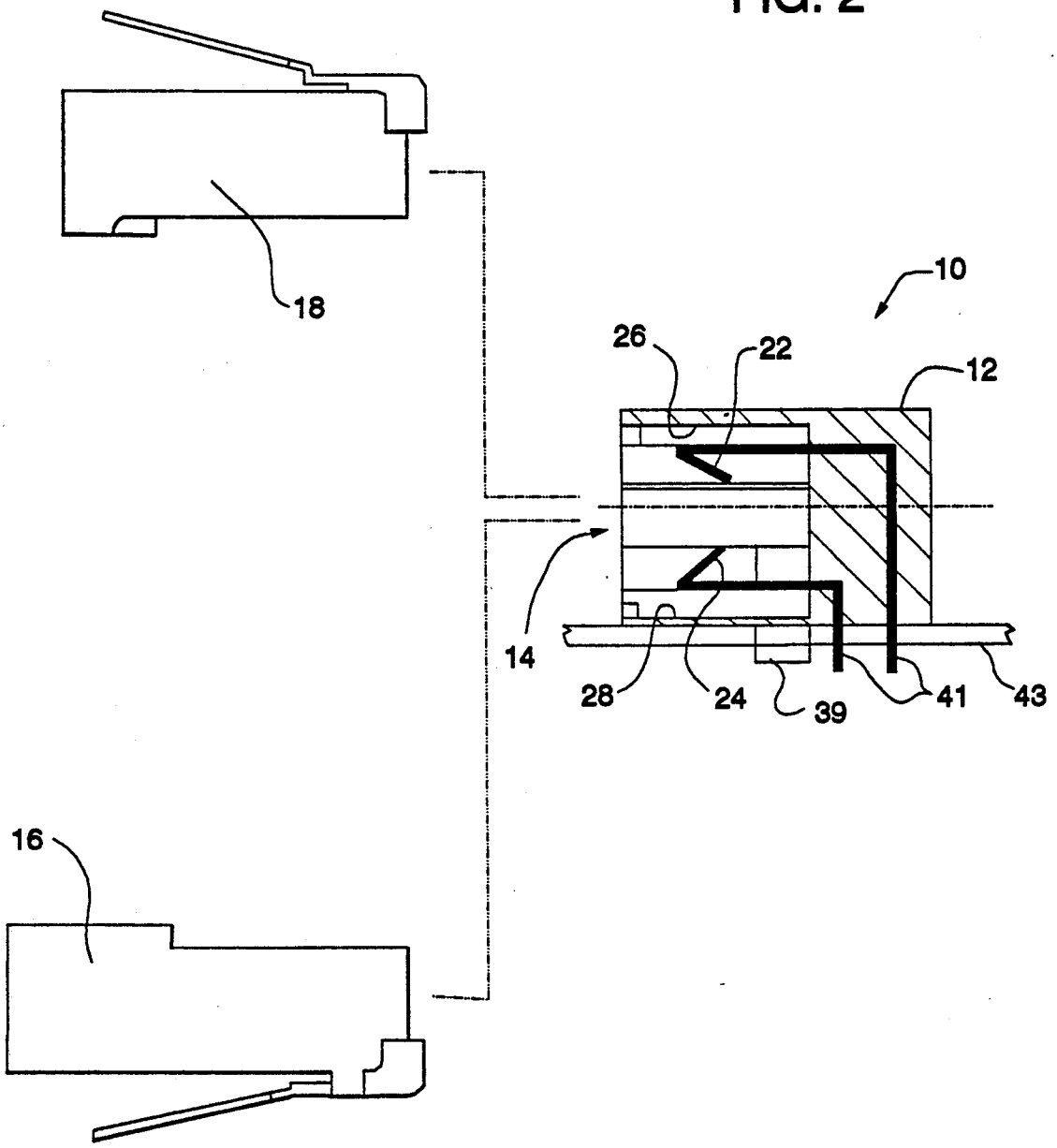
FIG. 2 is a cross-sectional view of the socket taken along line 2—2 as shown in FIG. 1, showing further the socket being mounted to a printed circuit board.

Snap-in hooks 39 (one shown in FIGS. 1, 2 and 3, four shown in FIGS. 4 and 5) allow the socket body 12 to be lockingly engaged to, for instance, a printed circuit board (43 in FIG. 2). Soldering terminals 41 provide connectivity to the printed circuit board.

Figure 4:
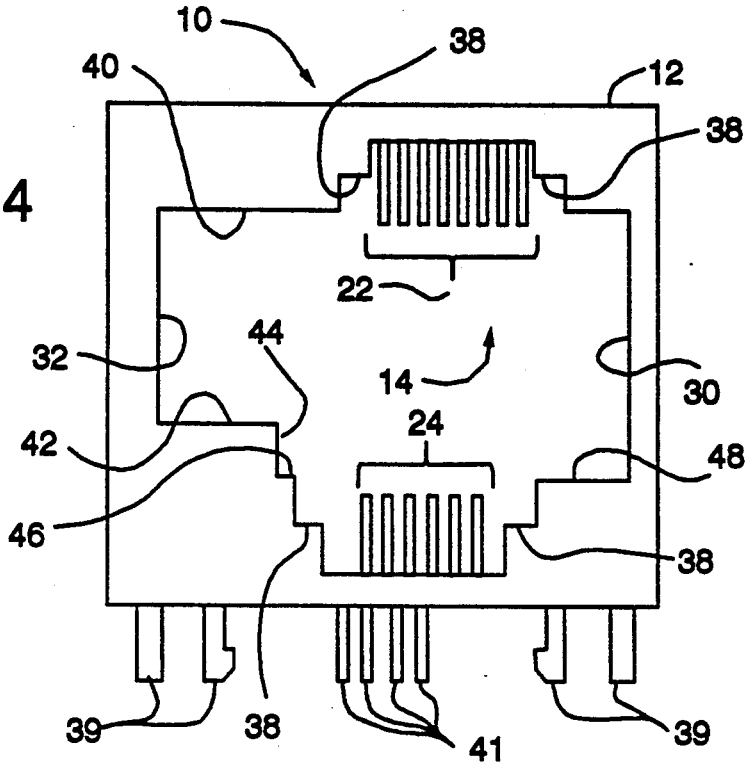
FIG. 4 is a front elevational view of the socket.

FIG. 4 illustrates a front elevational view of the socket of the present invention. Contact terminals 22 (eight) are used to engage the corresponding contact terminals of the ISDN plug when inserted while contact terminals 24 (six) are used to engage the corresponding contact terminals of the POTS plug when inserted. Because the contact terminals springingly protrude into the chamber 14, they are free to engage the corresponding contact terminals of the inserted plug. For example, contact terminals 22 engage the contact terminals of the ISDN plug when it is inserted. Further, because the contact terminals springingly protrude into the chamber 14, they make contact with corresponding terminals even when there are less corresponding terminals on the inserted plug. For instance, where there are only four terminals on the POTS plug, four of contact terminals 24 (normally the inner four) make contact with the terminals of the inserted POTS plug.

Figure 5:
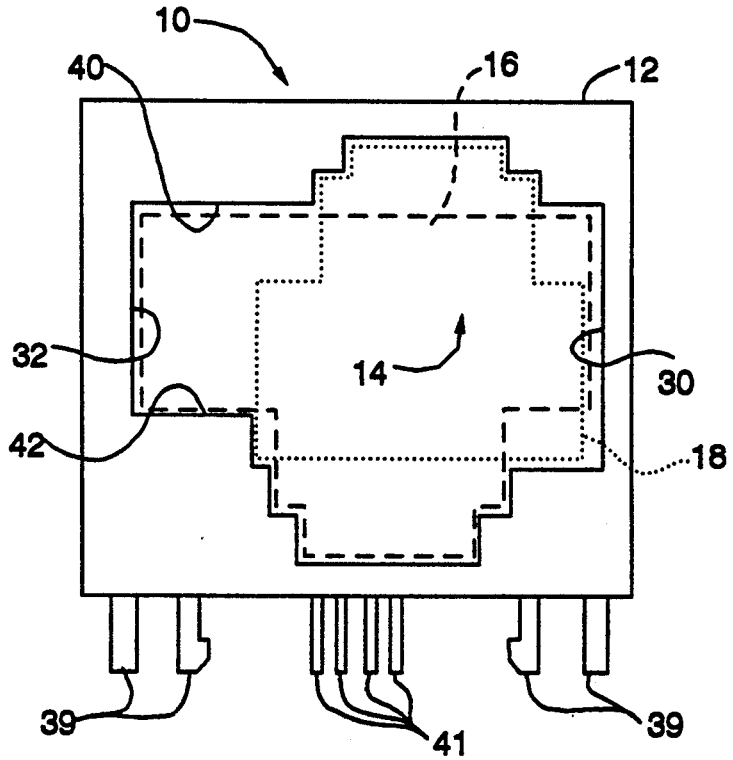
FIG. 5 is another front elevational view showing the plugs (ISDN and POTS) in dashed lines in their respective installed positions.

FIG. 5 illustrates another front elevational view showing the ISDN and POTS plugs 16 and 18, in their respective inserted positions, in dashed lines. The cross-section of the plug-receiving chamber 14 corresponds, in part, to the cross-section of the ISDN plug, and, further, in part, to the cross-section of the POTS plug. In particular, an ISDN plug-receiving portion is defined by the left and right walls 32 and 30 which provide lateral guidance for ISDN plug 16 while upper and lower ISDN plug guide walls 40 and 42 provide vertical guidance. The ISDN plug-receiving portion is further defined, at the bottom, by the ISDN plug guide 36 which guides and locks the plug into the chamber. Similarly, a POTS plug-receiving portion is defined by POTS plug left guide wall 44 and right wall 32 which act to provide lateral guidance to the inserted POTS plug 18 and further defined by lower POTS plug guide walls 46 and 48 which provide vertical guidance to the POTS plug 18 when inserted. The POTS plug-receiving portion is further defined, at the top, by the POTS plug guide 34 which guides and locks the plug into the chamber. As can be seen, the ISDN plug-receiving portion and the POTS plug-receiving portion share a common portion of the chamber defined by the logical intersection of the two plug-receiving portions.

The spring-like force exerted by contact terminals upon the inserted plug maintains the plug within the chamber while the POTS plug guide portion 34 and the ISDN plug guide portion 36 help keep the respective plugs in proper alignment so that proper connectivity can be made with contact terminals.

Thus, it can be seen that the socket of the present invention allows for one of multiple telephone plug types to be individually inserted therein thereby saving space while reducing the cost of the piece of equipment employing the socket. While the invention has been particularly shown and described with reference to preferred embodiments thereof, it will be understood by those skilled in the art that various other changes in form and detail may be made without departing from the spirit and scope of the invention.

What is claimed is:

1. A socket for receiving multiple types of telephone plugs comprising a body having a chamber therein for receiving any one of said multiple types of plugs, said chamber having a first plug-receiving portion for receiving a plug of a first type, a second plug-receiving portion for receiving a plug of a second type, said first plug-receiving portion having a first plug guide portion along one side of said chamber for guiding a portion of said first type, said second plug-receiving portion having a second plug guide portion along another side of said chamber for guiding a portion of said second type, said first plug guide portion having a set of contact terminals positioned for making contact with a corresponding set of contact terminals of a plug of said second type when said plug of said second type is inserted in said chamber, said second plug guide portion having a set of contact terminals positioned for making contact with a corresponding set of contact terminals of a plug of said first type when said plug of said first type is inserted in said chamber.

2. The socket defined in claim 1 wherein said first plug-receiving portion is positioned and dimensioned to receive said plug of said first type when said plug is in a first orientation and wherein said second plug-receiving portion is positioned and dimensioned to receive said plug of said second type when said plug is in a second orientation, said plug being in said second orientation being rotated one hundred and eighty degrees from said plug being in said first orientation.

3. The socket defined in claim 1 wherein said first plug-receiving portion and said second plug-receiving portion share a common portion for receiving a portion of a plug of said first type when said plug of said first type is inserted and a portion of a plug of said second type when said plug of said second type is inserted.

4. The socket defined in claim 3 wherein said first plug guide portion is disposed along an upper inner wall of said chamber and said second plug guide portion is disposed along a lower inner wall of said chamber, said upper inner wall being opposed to said lower inner wall.

5. The socket defined in claim 4 wherein said first type of said multiple types of plugs is an Integrated Services digital Network (ISDN) Basic Rate plug conforming to RJ-45.

6. The socket defined in claim 4 wherein said second type of said multiple types of plugs is a plain old telephone service (POTS) plug conforming to RJ-11.

* * * * *